US006652236B2

(12) United States Patent
Hai

(10) Patent No.: US 6,652,236 B2
(45) Date of Patent: Nov. 25, 2003

(54) FAN BLADE ASSEMBLY AND METHOD OF ASSEMBLING

(75) Inventor: Liang Hai, Kowloon (HK)

(73) Assignee: Hoo Cheung Group Ltd., Kowloon (HK)

( * ) Notice: Subject to any disclaimer, the term of this patent is extended or adjusted under 35 U.S.C. 154(b) by 77 days.

(21) Appl. No.: 09/996,414

(22) Filed: Nov. 29, 2001

(65) Prior Publication Data

US 2003/0099545 A1 May 29, 2003

(51) Int. Cl.[7] ..... F04D 29/60; F04D 29/34

(52) U.S. Cl. ..... 416/206; 416/210 R; 416/244 R

(58) Field of Search ..... 416/206, 207, 416/210 R, 214 R, 219 R, 219 A, 220 R, 220 A, 221, 244 R

(56) References Cited

U.S. PATENT DOCUMENTS 5,593,283 A * 1/1997 Scott ..... 416/244 R
6,010,306 A * 1/2000 Bucher et al. ..... 416/210 R
6,039,540 A 3/2000 Wu ..... 416/210 R
6,042,326 A 3/2000 Thomas et al.
6,241,476 B1 * 6/2001 Lee ..... 416/210 R
6,371,729 B1 * 4/2002 Tseng ..... 416/210 R
6,508,629 B2 * 1/2003 Kerr, Jr. ..... 416/210 R

FOREIGN PATENT DOCUMENTS

EP 1085216 A2 3/2001

* cited by examiner

*Primary Examiner*—Edward K. Look
*Assistant Examiner*—Richard A. Edgar
(74) *Attorney, Agent, or Firm*—Frommer Lawrence & Haug, LLP; Ronald R. Santucci

(57) ABSTRACT

A fan blade assembly includes a mounting arm having a first end adapted to engage a fan rotor and a second end adapted to receive a fan blade. At least two mounting posts are disposed on the second end of the mounting arm and a fan blade has apertures for receive the mounting posts. A clamp plate has apertures with a receiving portion and a retaining portion. The receiving portion is adapted to receive the mounting posts and the clamp plate is movable to a securing position where the retaining portions engages with the mounting posts to secure the clamp plate and fan blade to the mounting arm.

17 Claims, 6 Drawing Sheets

FAN BLADE ASSEMBLY AND METHOD OF ASSEMBLING

FIELD OF THE INVENTION

The invention relates to fan blade assemblies and to methods of assembling same. In particular, the invention relates to an assembly and method for connecting blades to ceiling fans.

The following discussion is particularly directed at fan blade assemblies for ceiling fans, however the invention will find application in other fan blade assemblies and such are considered within the scope of the invention.

BACKGROUND TO THE INVENTION

Decorative ceiling fans, which are popularly installed in homes and public places, have large market demand. This type of ceiling fan usually comprises motor, blades, blade brackets and light kit. Because the blade bracket and the blade are independent parts and a fan usually consists of 4–6 blades (and corresponding blade brackets) installation requires the use of professional tools together with screws and washers to manually attach the blades to the blade brackets. Assembling the blades and brackets constitutes a high percentage of the overall time and cost of installing a fan.

SUMMARY OF THE INVENTION

It is an object of the present invention to overcome or at least ameliorate the above mentioned problem or at least to provide the public with a useful alternative.

According to a first aspect of the invention there is provided a fan blade assembly including:

a mounting arm adapted to engage a fan rotor at a first end and having mounting posts at a second end, a fan blade having apertures to receive the mounting posts, and a clamp plate having apertures to receive the mounting posts and being movable to a securing position to secure the clamp plate and fan blade to the mounting arm.

The second end of the mounting arm has mounting posts threadably engaged thereto, said posts having a head portion and a body portion of substantially the same diameter and a neck portion, of smaller diameter, connecting the head and body portions. The clamp plate has apertures, each aperture has a receiving portion and a retaining portion, the receiving portion is adapted to receive the mounting posts and the clamp plate is movable to a securing position where the retaining portion engages with the neck portion of the mounting posts to secure the clamp plate and fan blade to the mounting arm.

According to a second aspect of the invention there is provided a fan blade assembly or ceiling fan assembly including:

a mounting arm comprising an elongate body having first and second ends, the first end adapted to engage a fan rotor and the second end adapted to receive a fan blade, at least two mounting posts, each of said posts having a head portion and a body portion of substantially the same diameter and a smaller diameter neck portion connecting the head and body portions, the body portion being engagable with the second end of the mounting arm, a fan blade having apertures adapted to receive the mounting posts, and a clamp plate having at least two apertures, each aperture having a receiving portion and a retaining portion, the receiving portion adapted to receive the mounting posts, and the clamp plate being movable to a securing position where the retaining portion engages with the neck portion of the mounting posts to secure the clamp plate and fan blade to the mounting arm.

According to further aspect of the invention there is provided a kit-set for adaptation of a fan blade assembly or ceiling fan including:

at least two mounting posts, each of said posts having a head portion and a body portion of substantially the same diameter and a smaller diameter neck portion connecting the head and body portions, the body portion being engagable with a fan blade mounting arm, and a clamp plate having at least two apertures, each aperture having a receiving portion and a retaining portion, the receiving portion adapted to receive the mounting posts, and the clamp plate being movable to a securing position where the retaining portion engages with the neck portion of the mounting posts to secure the clamp plate and fan blade to the mounting arm.

The kit-set may include a fan blade having apertures for receive the mounting posts.

In each aspect a lock can be provided on the clamp plate, the lock comprising a strip having an upwardly extending tab at one end, the lock being disposed on the clamp plate so that the one end is in communication with the receiving portion of one aperture in the clamp plate and being extendable upwards to allow the aperture to receive a mounting post. Preferably, the lock is made of flat spring steel or similar material.

Further aspects of the invention will become apparent from the following description, which is given by way of example only.

BRIEF DESCRIPTION OF THE DRAWINGS

Embodiments of the invention will now be described by way of example only and with reference to the accompanying drawings in which.

DESCRIPTION OF THE PREFERRED EMBODIMENTS

Figure 1:
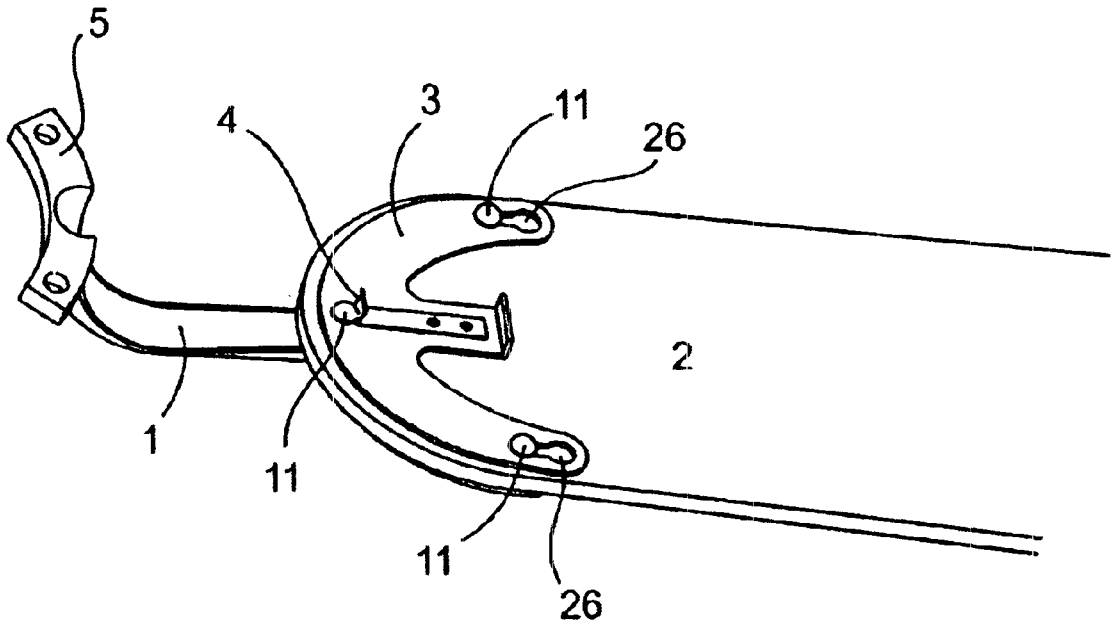
FIG. 1 illustrates a perspective view of a fan blade assembly according to the invention.
Figure 2:
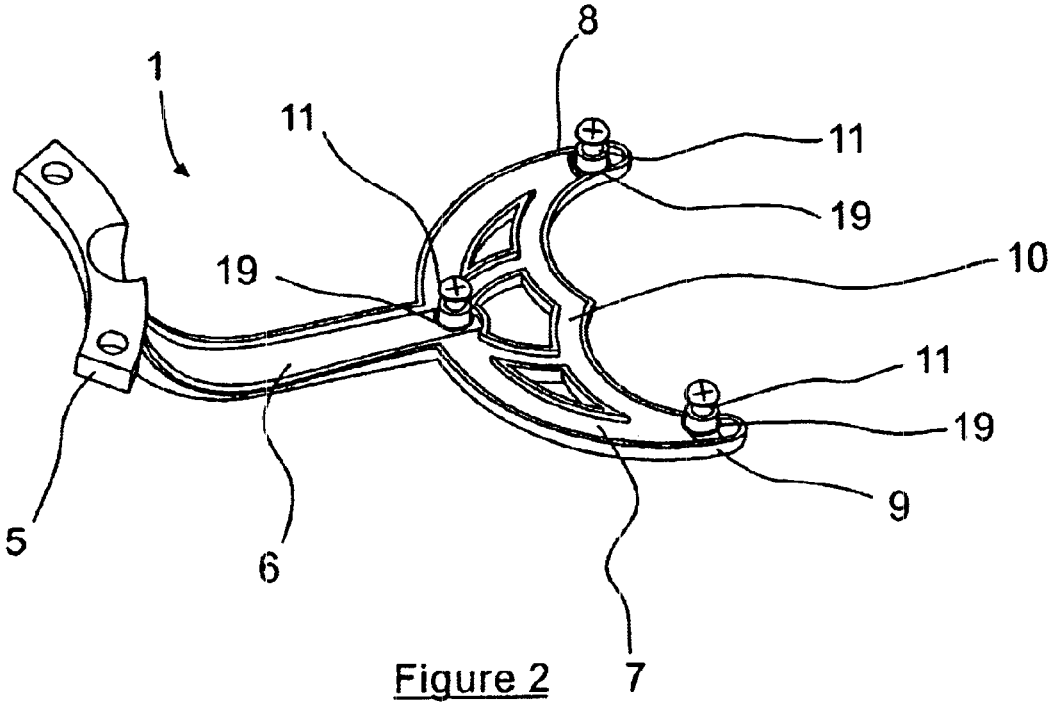
FIG. 2 illustrates a perspective view of a mounting arm according to the invention.

Referring to FIG. 1 a preferred embodiment of invention includes a fan mounting arm 1, a fan blade 2, and a clamp plate 3 with a lock in the form of a retainer spring tab 4. The components are illustrated in more detail in FIGS. 2 to 4.

The mounting arm 1 comprises a bracket 5 for securing the mounting arm 1 to a fan rotor (not shown) in known manner. The bracket 5 extends via an elongate body 6 to a fan mounting head 7. The mounting head 7 is a substantially "C" shaped bracket having outer arm portions 8 and 9 enclosing a supporting web portion 10 there between. Again, mounting head 7 is substantially of known type.

Figure 6:
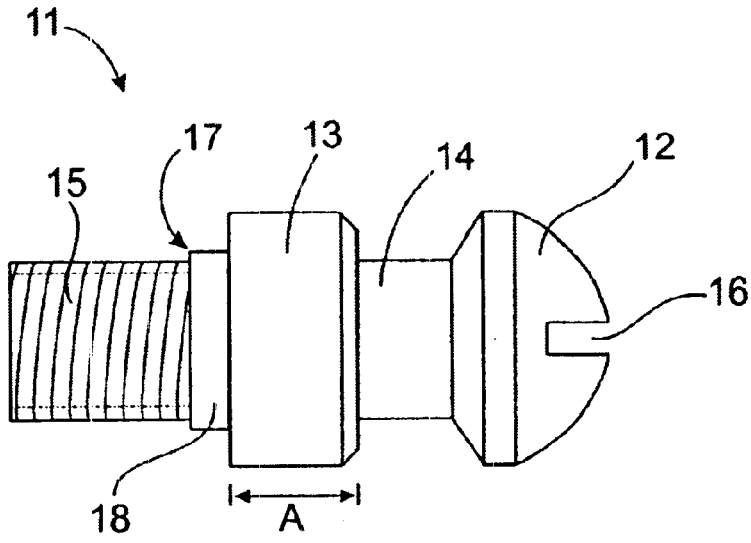
FIG. 6 illustrates a side view of a mounting post according to the invention.

Engaged with the mounting head 7 are three mounting posts 11, which are illustrated in more detail in FIG. 6. One mounting post 11 is located at the distal end of each arm 8 and 9 and the third mounting post 11 is located in the centre portion of the mounting head 7 proximate the elongate body 6.

It is advantageous to turn now to the mounting post 11 illustrated in FIG. 6. The post 11 comprise a head portion 12 and body portion 13 connected via a narrow neck portion 14. For reasons that will become apparent later, the body portion 13 has a longitudinal length (A) substantially equal to, but no greater than, the thickness of fan blades 2.

At the distal end of the body portion 13 there is a threaded portion 15 that facilitates engagement of the post 11 with the head 7 of the mounting arm 1. Preferably, treaded portion 15 is of a standard thread configuration so as to be compatible with known mounting arms 1. A screwdriver slot 16 is provided to allow the posts 11 to be secured to head 7.

An additional recessed portion 18 is provided on body 13 adjacent threaded portion 15. When threadably engaged the post 11 secures when surface 17 bears against the periphery of a threaded bore in head 7. A rubber, or similar, washer (19 in FIG. 2) has an external diameter larger than body 13 and a central aperture corresponding to the diameter of portion 18. The washer 19 locates about portion 18 when post 11 is engaged with head 7. Washer 19 is not critical to the invention, however it helps prevent vibration noise from the fan blade in use as will become apparent latter.

Figure 3:
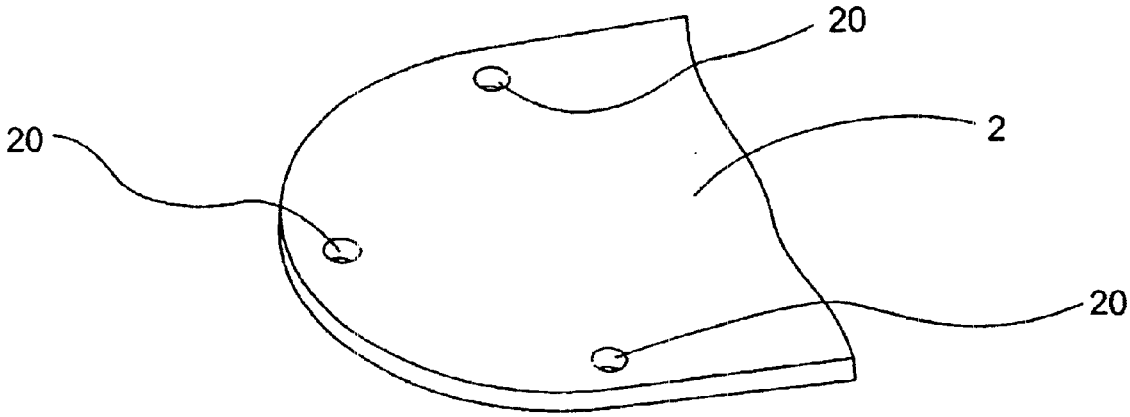
FIG. 3 illustrates a perspective view of the proximal end of a fan blade according to the invention.

Turning to FIG. 3, shown is the proximal end only of fan blade 2. The blade 2 has three apertures 20 corresponding with the positions of posts 11 on head 7. In known manner the blade 2 would be aligned with head 7 and conventional screws or bolts passed through apertures 20 and threadably engaged with threaded bores in head 7. However in the preferred embodiment of the invention the posts 11, with washers 19, are threadably engaged within the threaded bores in head 7. Blade 2 is then located against head 7 so that posts 11 extend through apertures 20 in the blade 2. As body portion 13 of post 11 is substantially the same thickness as blade 2, neck portion 14 and head 16 will be clear of aperture 20.

Figure 4:
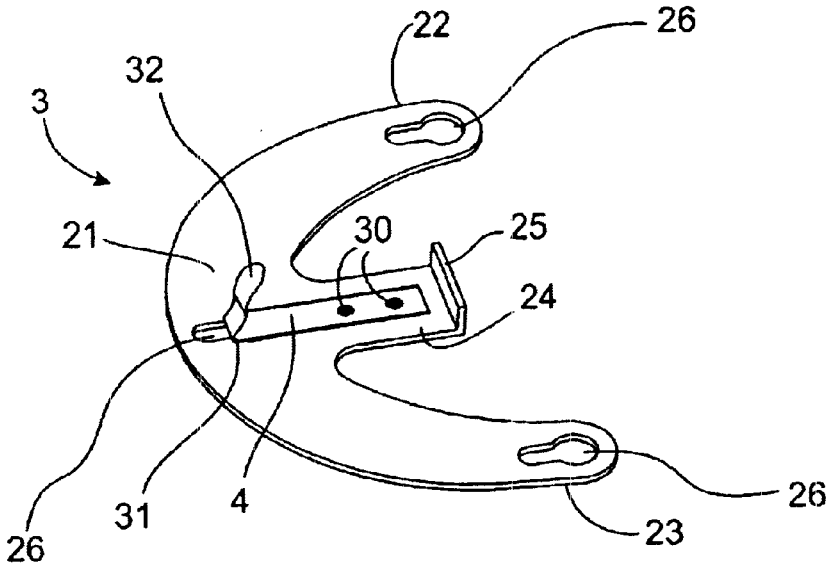
FIG. 4 illustrates a perspective view of a clamp plate according to the invention.
Figure 5:
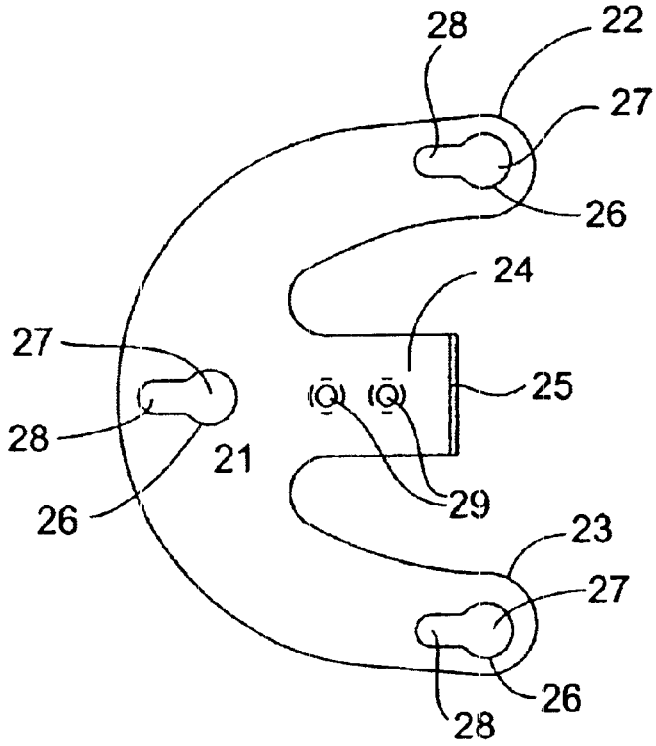
FIG. 5 illustrates a plan view of the clamp plate.

Looking now at FIG. 4, the clamp plate 3 is a substantially "C" shaped flat plate having a central span portion 21 extending curvedly in each direction to outer arm portions 22 and 23. Extending orthogonal to central portion 21 is an inner arm portion 24 that terminates in an upwardly presented tab 25. FIG. 5 shows a plan view of clamp plate 3. It is provide with three apertures 26, one aperture at the distal end of each outer arm portion 22 and 23 and the third located centrally in the central span portion 21. Each aperture 26 is a "keyhole" shape having a larger receiving portion 27 and an elongate retaining portion 28.

On the longitudinal axis of inner arm 24 are two smaller "fixing" apertures 29 which are provided for attaching the retainer spring tab 4 via nuts and bolts 30 (see FIG. 3).

Retainer spring tab 4 is an elongate strip of flat spring steel with two apertures provided on its longitudinal axis corresponding to "fixing" apertures 29. It extends centrally along the longitudinal axis of inner arm 24. At its distal end 31 it extends upwardly to form a "lifting" tab 32.

Retainer spring tab 4 is dimensioned and arranged so that distal end 31, bearing tab 32, covers (or closes) receiving portion 27 of the aperture 26 on central portion 21 of the clamp plate 3. The spring tab 4 must not cover (or close) the retaining portion 28 of aperture 26. Furthermore, the fixing apertures 29 and securing bolts 30 should be sufficiently remote from distal end 31 that end 31 can be raised clear of receiving portion 27, using tab lifting 32, without the aid of tools.

The embodiment will be more clearly illustrated by reference to the mode of use.

Figure 7:
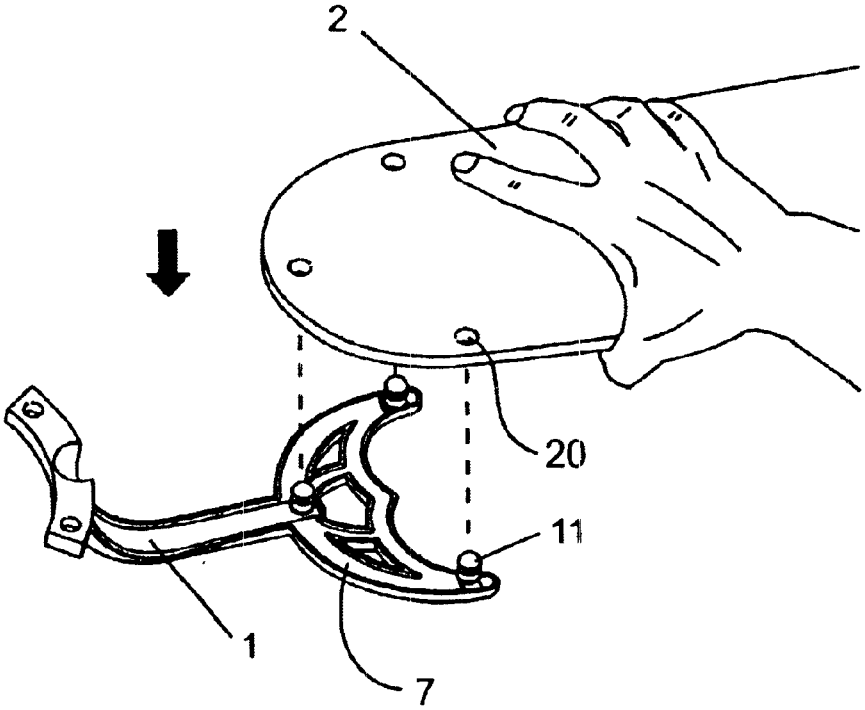
FIG. 7 illustrates the first step in mounting a fan blade from an assembly according to the invention.
Figure 8:
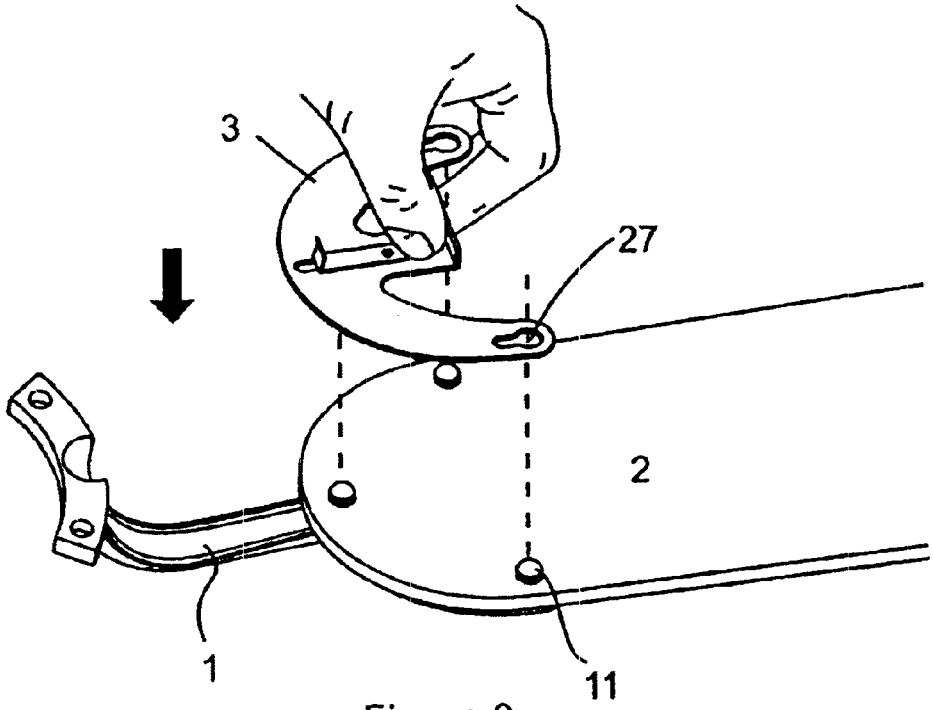
FIG. 8 illustrates the second step in mounting the fan blade.
Figure 9:
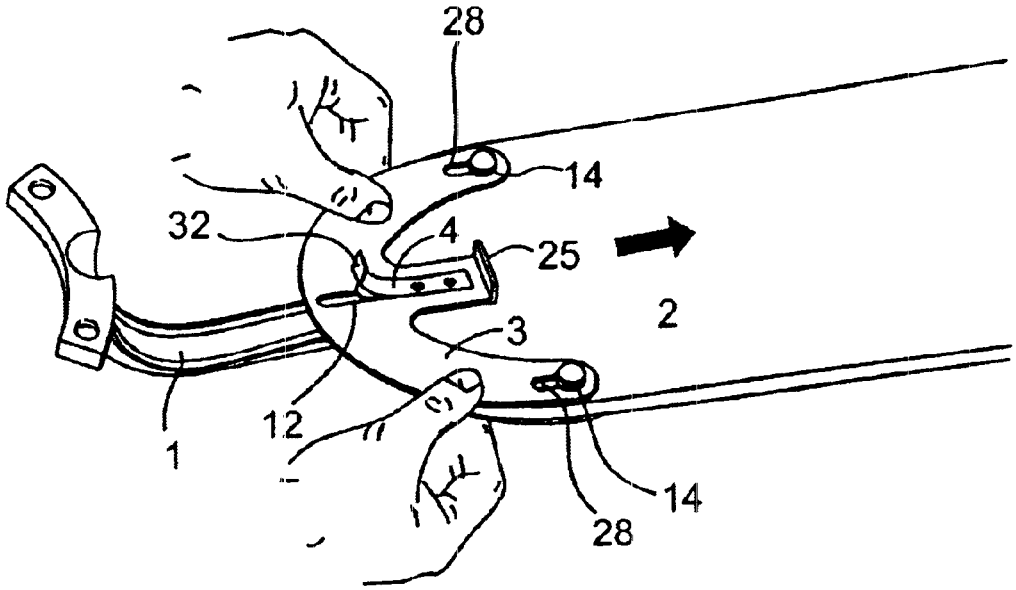
FIG. 9 illustrates the third step in mounting the fan blade.

Referring to FIG. 7, to secure blade 2 to the mounting arm 1 the blade 2 is lowered into position on the head 7 letting the mounting posts 11 pass through the corresponding apertures 20 in the blade 2 and extend above the blade surface (see FIG. 8). The clamp plate 3 is lowered into position by letting the mounting posts 11 pass through the receiving portions 27 of apertures 26. At this time the spring tab extends (springs) upwards (see FIG. 9). Using tab 25, or by pushing on the plate 3 as illustrated, the clamp plate 3 is moved toward the distal end of the blade 22, as shown in FIG. 9, until the retaining portions 28 of apertures 26 are completely coordinated with the neck portions 14 of the mounting posts 11. At this time the spring tab 4 springs down, standing up against the head 12 of pin 11 securing and locking the plate 3 and blade 2 to the mounting arm 1. Thus the blade assembly is finished.

Assembly of the blade 2 and the arm 1 can be performed without professional tools and numerous fasteners. By using this assembling method the blade 2 can be installed on the blade arm 1 not only easily and quickly but also simply and conveniently.

Figure 10:
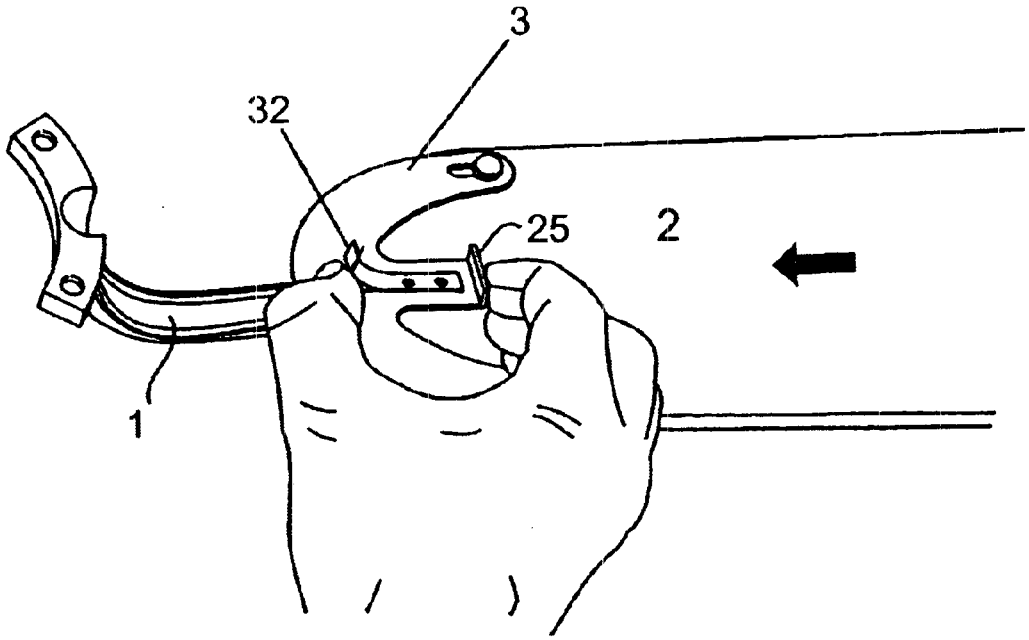
FIG. 10 illustrates the first step in removing a fan blade from an assembly according to the invention, and FIG. 11 illustrate the second step in removing the fan blade.
Figure 11:
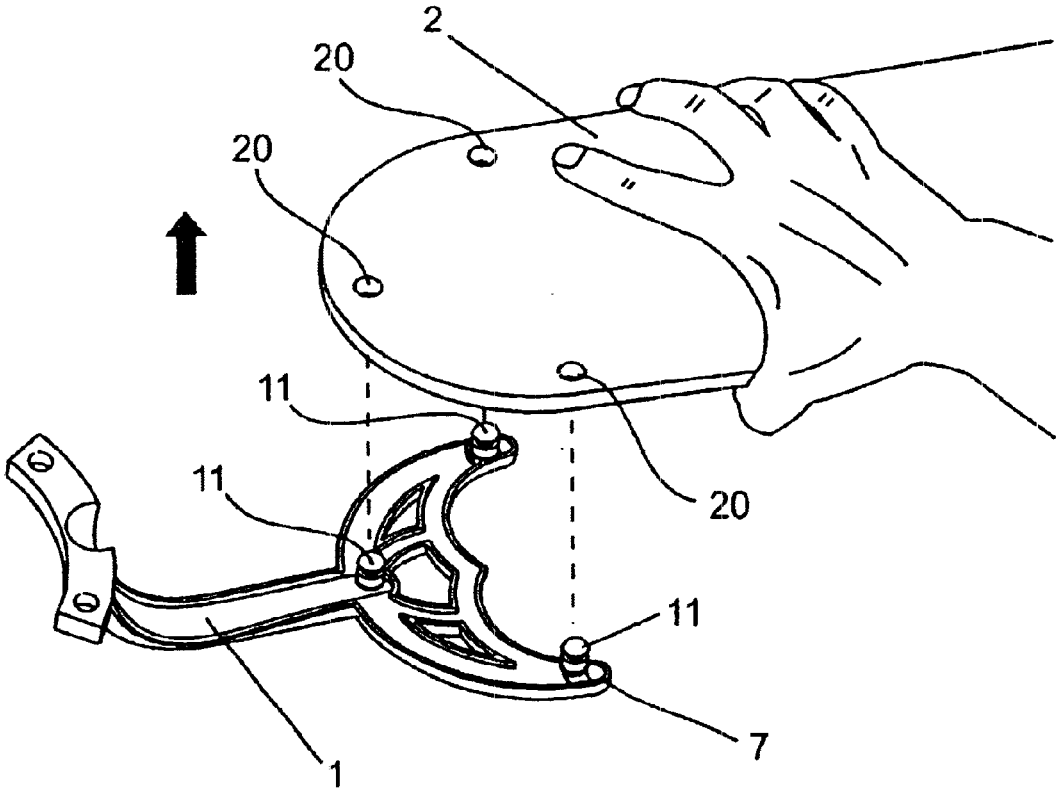

The fan blade can be removed just as easily. Referring to FIGS. 10 and 11, to remove the blade lifting tab end 32 of spring tab 4 is lifted clear of post head 12. Holding spring tab 4 clear of the post 11, clamp plate 3 is moved in the direction of the proximal end of the fan blade 2. This releases neck portions 14 of posts 11 from retaining portions 28 (see FIG. 10). Once released the clamp plate 3 can be removed and then the blade 2 lifted off head 7 of mounting arm 1 (see FIG. 11).

It will be apparent to the skilled addressee that in one embodiment the invention will comprise a kit-set or after market accessory for modifying known fan blade assemblies in accordance with the invention. Mounting arm 1 (less the mounting post 11) shown in the drawings is substantially the same as those known in the art. A kit-set comprises three mounting posts 11 and washers 29, and a clamp plate 3 with spring tab 4.

To modify known fans the mounting posts 11 and washes 29 are threadably engaged with threaded bores on head 7 of mounting arm 1. Depending on the configuration, apertures 20 in the blades might need enlarging to accommodate posts 11. This can be achieved simply by use of an electric, or other, drill.

In an alternative embodiment blades will also be included in the kit-set, for example a vendor will make available after market decorative blades complete with mounting kit-set according to the invention.

It is appreciated that in kit-set form the invention requires tools, for example at least a screwdriver and possibly a drill and bit. However, the invention still has utility as once the mounting arms, and blades if required, have been modified according to the invention blades may be subsequently changed/removed without the use of tools. This has advantage for cleaning purposes or if blades are regularly changed for decorative reasons, for example a person might have Christmas blades, Easter blades, summer blades, winter blades, etc.

Where in the foregoing description reference has been made to integers or elements have known equivalents then such are included as if individually set forth herein.

Embodiments of the invention have been described, however it is understood that variations, improvement or modifications can take place without departure from the sprite of the invention or scope of the appended claims.

I claim:

1. A fan blade assembly including:

a mounting arm adapted to engage a fan rotor at a first end and having three mounting posts at a second end threadably engaged thereto, each of said posts having a head portion and a body portion of substantially the same diameter and a neck portion, of smaller diameter, connecting the head and body portions;

a fan blade having three apertures to receive the mounting posts; and a clamp plate having three apertures, wherein each aperture is configured in a keyhole shape having a larger receiving portion and an elongated retaining portion, the receiving portion being adapted to receive the mounting posts, and the clamp plate being movable to a securing position where the retaining portion engages with the neck portion of the mounting posts to secure the clamp plate and fan blade to the mounting arm.

2. A fan blade assembly as claimed in claim 1 wherein a lock is provided on the clamp plate, the lock comprising a strip having an upwardly extending tab at one end, the lock being disposed on the clamp plate so that the one end is in communication with the receiving portion of one aperture in the clamp plate and being extendable upwards to allow the aperture to receive a mounting post.

3. A fan blade assembly as claimed in claim 2 wherein the lock is made of flat spring steel or similar material.

4. A fan blade assembly including:

a mounting arm comprising an elongate body having first and second ends, the first end adapted to engage a fan rotor and the second end adapted to receive a fan blade;

at least two mounting posts, each of said mounting posts having a head portion and a body portion of substantially the same diameter and a smaller diameter neck portion connecting the head and body portions, the body portion being engagable with the second end of the mounting arm;

a fan blade having apertures for receive the mounting posts; and a clamp plate having at least two apertures, wherein each aperture is configured in a keyhole shape having a larger receiving portion and an elongated retaining portion, the receiving portion adapted to receive the mounting posts and the clamp plate being movable to a securing position where the retaining portion engages with the neck portion of the mounting posts to secure the clamp plate and fan blade to the mounting arm.

5. A fan blade assembly as claimed in claim 4 wherein a lock is provided on the clamp plate, the lock comprising a strip having an upwardly extending tab at one end, the lock being disposed on the clamp plate so that the one end is in communication with the receiving portion of one aperture in the clamp plate and being extendable upwards to allow the aperture to receive a mounting post.

6. A fan blade assembly as claimed in claim 5 wherein the lock is made of flat spring steel or similar material.

7. A ceiling fan assembly including:

a mounting arm comprising an elongate body having first and second ends, the first end adapted to engage a fan rotor and the second end adapted to receive a fan blade;

at least two mounting posts, each of said posts having a head portion and a body portion of substantially the same diameter and a smaller diameter neck portion connecting the head and body portions, the body portion being engagable with the second end of the mounting arm, a fan blade having apertures adapted to receive the mounting posts; and a clamp plate having at least two apertures, wherein each aperture is configured in a keyhole shape having a larger receiving portion and an elongated retaining portion, the receiving portion adapted to receive the mounting posts and the clamp plate being movable to a securing position where the retaining portion engages with the neck portion of the mounting posts to secure the clamp plate and fan blade to the mounting arm.

8. A ceiling fan blade assembly as claimed in claim 7 wherein a lock is provided on the clamp plate, the lock comprising a strip having an upwardly extending tab at one end, the lock being disposed on the clamp so that the one end is in communication with the receiving portion of one aperture in the clamp plate and being extendable upwards to allow the aperture to receive a mounting post.

9. A ceiling fan blade assembly as claimed in claim 8 wherein the lock is made of flat spring steel or similar material.

10. A kit-set for adaptation of a fan blade assembly including:

at least two mounting posts, each of said posts having a head portion and a body portion of substantially the same diameter and a smaller diameter neck portion connecting the head and body portions, the body portion being adapted to engage with a fan blade mounting arm; and a clamp plate having at least two apertures, wherein each aperture is configured in a keyhole shape having a larger receiving portion and an elongated retaining portion, the receiving portion adapted to receive the mounting posts and the clamp plate being movable to a securing position where the retaining portion engages with the neck portion of the mounting posts.

11. A kit-set as claimed in claim 10 wherein a lock is provided on the clamp plate, the lock comprising a strip having an upwardly extending tab at one end, the lock being disposed on the clamp plate so that the one end is in communication with the receiving portion of one aperture in the clamp plate and being extendable upwards to allow the aperture to receive a mounting post.

12. A kit-set as claimed in claim 11 wherein the lock is made of flat spring steel or similar material.

13. A kit-set as claimed in claim 10, wherein an upwardly presented tab is provided on said clamp plate to facilitate manual lateral movement of the clamp plate to a securing position.

14. A kit-set for adaptation of a fan blade assembly including:

at least two mounting posts, each of said posts having a head portion and a body portion of substantially the same diameter and a smaller diameter neck portion connecting the head and body portions, the body portion being adapted to engage with a fan blade mounting arm;

a fan blade having apertures for receive the mounting posts; and a clamp plate having at least two apertures, wherein each aperture is configured in a keyhole shape having a larger receiving portion and an elongated retaining portion, the receiving portion adapted to receive the mounting posts and the clamp plate being movable to a securing position where the retaining portion engages with the neck portion of the mounting posts.

15. A kit-set as claimed in claim 13 wherein a lock is provided on the clamp plate, the lock comprising a strip having an upwardly extending tab at one end, the lock being disposed on the clamp plate so that the one end is in communication with the receiving portion of one aperture in the clamp plate and being extendable upwards to allow the aperture to receive a mounting post.

16. A kit-set as claimed in claim 14 wherein the lock is made of flat spring steel or similar material.

17. A kit-set as claimed in claim 14, wherein an upwardly presented tab is provided on said clamp plate to facilitate manual lateral movement of the clamp plate to a securing position.

* * * * *